United States Patent [19]

Oyama et al.

[11] Patent Number: 4,935,712

[45] Date of Patent: Jun. 19, 1990

[54] OPERATION MECHANISM OF A CIRCUIT BREAKER ALLOWING AUTOMATIC OR MANUAL OPERATION

[75] Inventors: Kazuaki Oyama; Hideo Nojiri, both of Marugame, Japan

[73] Assignee: Mitsubishi Denki Kabushiki Kaisha, Tokyo, Japan

[21] Appl. No.: 241,247

[22] Filed: Sep. 7, 1988

[30] Foreign Application Priority Data

Sep. 26, 1987 [JP] Japan ..... 62-241061
Sep. 26, 1987 [JP] Japan ..... 62-241062
Sep. 26, 1987 [JP] Japan ..... 62-241063

[51] Int. Cl.[5] ..... H01H 9/20

[52] U.S. Cl. ..... 335/164; 200/401; 335/191

[58] Field of Search ..... 200/401, 400, 33 R; 335/23, 38, 59, 64, 166, 189, 191, 164, 165, 174

[56] References Cited

U.S. PATENT DOCUMENTS 4,165,453 8/1979 Hennemann ..... 200/401
4,260,865 4/1981 Horiuchi ..... 200/320

FOREIGN PATENT DOCUMENTS 53-161266 12/1978 Japan .

*Primary Examiner*—J. R. Scott
*Attorney, Agent, or Firm*—Burns, Doane, Swecker & Mathis

[57] ABSTRACT

An operation mechanism of a circuit breaker which allows either automatic or manual operation of the circuit breaker. The mechanism includes a moving contact lever, a hook lever, a handle, a pair of toggle links connecting the hook lever and the moving contact lever, an operation lever linked to the handle, and a spring connected between the operation lever and a joint of the toggle links. The operation mechanism may also include opening and closing delay latches which preclude movement of the toggle links until the handle has been fully turned to either one of two positions.

5 Claims, 8 Drawing Sheets

OPERATION MECHANISM OF A CIRCUIT BREAKER ALLOWING AUTOMATIC OR MANUAL OPERATION

FIELD OF THE INVENTION AND RELATED ART STATEMENT

1. Field of the Invention

The present invention relates to an operation mechanism of a circuit breaker which is to be used for switching of electric power lines, and especially relates to an improved operation mechanism of a circuit breaker.

2. DESCRIPTION OF THE RELATED ART

A conventional operation mechanism of a circuit breaker, for example, shown in the U.S. Pat. No. 4,260,865 is described in reference to FIG. 8.

In FIG. 8, an operation lever 1 is borne by a pivot 10 fixed on a frame 16. A pin 14 is provided on the operation lever 1 and an end of a tension spring 2 is hooked on the pin 14 and the other end thereof is hooked on a pin joint 6 which connects link levers 8 and 13. The link lever 8 is also rotatably borne by a pin 15 provided on a moving contact lever 17. The moving contact lever 17 is rotatably borne by a pivot 9 fixed on the frame 16. A moving contact 3 is mounted on an open end of the moving contact lever 17. On a position of the frame 16 facing the moving contact 3, a fixed contact 4 is provided. The moving contact 3 and the fixed contact 4 serves as switching electrodes. The other end of the link lever 13 is borne by a pin 5 on a hook lever 7. The hook lever 7 is rotatably borne by a pivot 11 fixed on the frame 16 and an end 7*a* of the hook lever 7 is hooked by a lock lever 12 which is driven by a tripping mechanism (not shown in the figure). The lock lever 12 is rotatably borne by a pivot 18. FIG. 8 shows the reset state of the circuit breaker, in which the moving contact 4 and the fixed contact 3 are opened.

The action of the above-mentioned conventional operating mechanism of the circuit breaker is as follows. When the operation lever 1 is rotated in the clockwise direction, the pin 14 is also rotated in the clockwise direction around the pivot 10 in FIG. 8. Accordingly, the tension spring 2 which is hooked between the pin 14 and the pin joint 6 is gradually extended. A force stored in the tension spring 2 serves to rotate the link lever 13 in the clockwise direction of FIG. 8 around the pin 5 as long as a virtual line which links the pins 14 and 6 is between from one-dotted chain line A and one-dotted chain line B. The link lever 13 is, however, captured by the restraint due to the link lever 8 as a long as the moving contact 3 departs from the fixed contact 4.

However, when the above-mentioned virtual line crosses over the one-dotted chain line B, the link 13 is rotated in conterclockwise direction by the force stored in the tension spring 2. As a result, the pin joint 6 is largely moved in the right-hand direction in FIG. 8, and the link lever 8 pushes the pin 15 down so that it rotates in the clockwise direction. When the pin 15 is pushed down, the moving contact lever 17 rotates in the clockwise direction around the pivot 9 and the moving contact 3 comes into contact with the fixed contact 4, and thereby an electric power line is switched on.

Similarly, when the operation lever 1 is rotated in the counterclockwise direction from the closed state of the circuit breaker, the link lever 13 is rotated in clockwise direction by a reversal of the above-mentioned action, and the moving contact 3 departs from the fixed contact 4 and the electric powerline is switched off.

On the other hand, when the lock lever 12 is rotated in the counterclockwise direction around the pivot 18 responding to a tripping mechanism not shown in the figure and the engagement of the hook lever 7 is released, the hook lever 7 rotates in the clockwise direction around the pivot 11 by the force stored in the tension spring 2 regardless of the closing operation being completed or in process. As a result, the pin joint 6 and the link lever 8 are raised upward, and the moving contact lever 17 which is connected to the link lever 8 by the pin 15 is rotated in the counterclockwise direction. Therefore, the moving contact 3 departs from the fixed contact 4 and the electric power line is switched off.

A handle 1*a* is provided on an end of the operation lever 1, for operating thereof. The handle 1*a* should be formed on a position on the operation lever 1 where the displacement is largest, so as to reduce the operating force. The operating force and the moving distance of the handle 1 become larger as the size and capacity of the circuit breaker become larger. As a result, the conventional operation mechanism of the circuit breaker has the disadvantage that the operation for moving the handle with a finger tip becomes difficult, either because a large force is necessary or because positioning space for the circuit breaker is limited and large space for positioning is necessary when a long size handle 1*a* is adopted to enable handling with less power.

Furthermore, closing and opening operations of the moving contact 3 and the fixed contact 4 are completed before the operation lever 1 reaches the final positions, because the force stored in the tension spring 2 moves the moving contact lever 17 down and up when the virtual line linking the pin 14 and the pin joint 6 crosses over the one-dotted chain line B in opening and closing operations. Therefore, a tension spring 2, a strong (having a large spring constant) must be used for obtaining sufficient driving force. And also, for receiving such a large force of the tension spring 2 and for bearing impacts due to discharged energy of the tension spring 2, all elements of the operation mechanism of the circuit breaker must be rigid and strong.

OBJECT AND SUMMARY OF THE INVENTION

An object of the present invention is to provide an improved operation mechanism of a circuit breaker which is relatively easier for positioning or operating than that of the conventional one and by which a weak spring can drive a moving contact stably.

An operation mechanism of a circuit breaker in accordance with the present invention comprises:

a moving contact lever, rotatably borne at one end thereof by a first pivot and having a moving contact on the other end thereof;

a hook lever, rotatably borne at one end thereof by a second pivot and hooked at the other end by a latch apparatus;

first and second toggle links coupled by a pin joint serving as a toggle joint for joining a first point on the moving contact lever and a second point on the hook lever;

an operation lever, rotatably borne at one end thereof by a third pivot;

a spring, disposed between a third point which is apart by a predetermined distance from the third pivot and the pin joint of the first and the second toggle links, for supplying a force stored therein to the moving contact lever;

a handle rotatably borne by a fourth pivot disposed on a frame and having an arm; and a link lever for linking the arm of the handle and a point on the operation lever.

Another operation mechanism of a circuit breaker in accordance with the present invention comprises:

a moving contact lever, rotatably borne at one end thereof by a first pivot and having a moving contact on the other end thereof;

a hook lever, rotatably borne at one end thereof by a second pivot and hooked at the other end by a latch apparatus;

first and second toggle links coupled by a pin joint serving as a toggle joint for joining a first point on the moving contact lever and a second point on the hook lever;

an operation lever, rotatably borne at one end thereof by a third pivot;

a spring, disposed between a third point which is apart by a predetermined distance from the third pivot and the joint of the first and the second toggle links, for supplying a force stored therein to the moving contact lever; and a closing operation delay latch, rotatably borne at a midway position thereof by a fourth pivot, having a notch at a predetermined position and a contacting part on the other end for contacting the operation lever when the operation lever comes close to a final position in the closing operation, and holding the moving contact lever at an opening position of the circuit breaker by coupling the notch to a protrusion of the moving contact lever when the operation lever is at reset position.

Still another operation mechanism of a circuit breaker in accordance with the present invention comprises:

a moving contact lever, rotatably borne at one end thereof by a first pivot and having a moving contact on the other end thereof;

a hook lever, rotatably borne at one end thereof by a second pivot and hooked at the other end by a latch apparatus;

first and second toggle links coupled by a pin joint serving as a toggle joint for joining a first point on the moving contact lever and second point on the hook lever;

an operation lever, rotatably borne at one end thereof by a third pivot;

a spring, disposed between a third point which is apart by a predetermined distance from the third pivot and the pin joint of the first and the second toggle links, for supplying a force stored therein to the moving contact lever; and an opening operation delay latch, rotatably borne at a midway position thereof by a fourth pivot, having a notch on an end part for coupling and holding the pin joint of the first and second toggle links at a predetermined position and a contacting part of the other end for contacting the operation lever and being driven thereby when the operation lever comes close to a final position in the opening operation, and holding the moving contact lever at a closing position of the circuit breaker by coupling the notch to the pin joint of the first and second toggle links when the operation lever is at closed position.

As mentioned above, one feature of the present invention is that the operation lever in a toggle link mechanism is driven by a handle with linking of the link lever, so that the space for positioning the circuit breaker can be reduced and the operating force can also be reduced. Furthermore, since the present invention has an opening delay latch or a closing operation delay latch for preventing the operation of the toggle links mechanism until the spring for driving the toggle link mechanism crosses over a predetermined position that is the final position of the closing operation or opening operation, the force stored in the spring can be effectively used. Therefore, the circuit breaker can be operated stably by a relatively weak spring in comparison with the conventional one.

DESCRIPTION OF THE PREFERRED EMBODIMENTS

A first preferred embodiment of an operation mechanism of a circuit breaker in accordance with the present invention is described with reference to FIG. 1, FIG. 2, FIG. 3, FIG. 4, FIG. 5 and FIG. 6.

Figure 5:
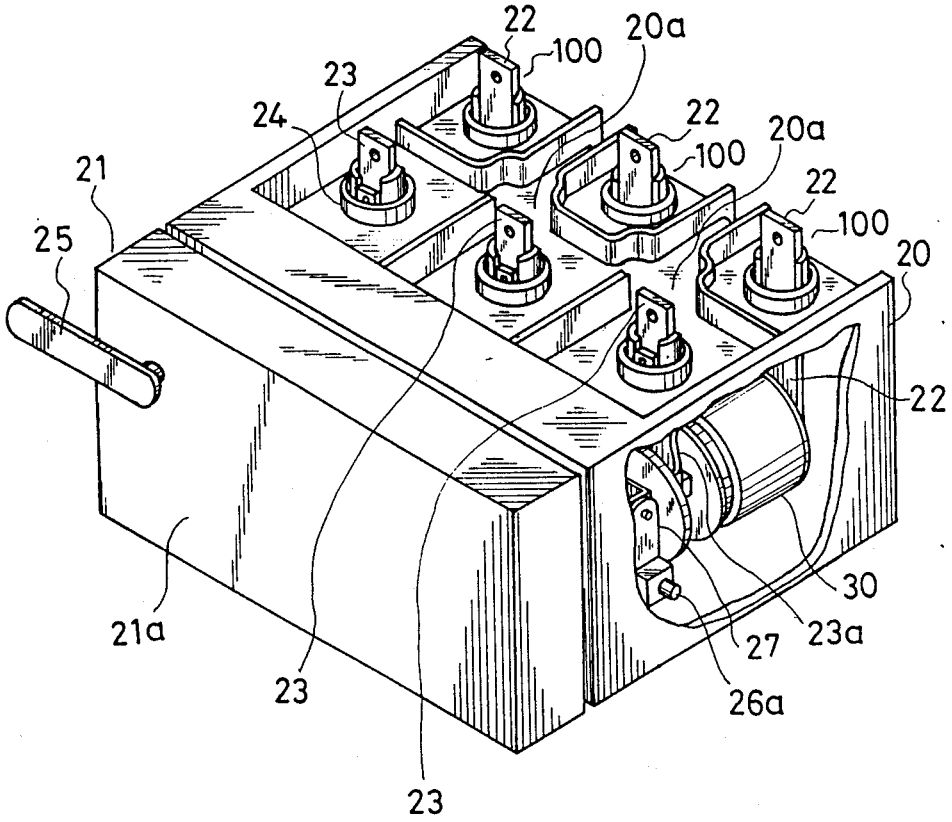
FIG. 5 is a perspective view showing a circuit breaker, including a breakaway view showing the side of a main part of the circuit breaker.

FIG. 5 is a perspective view showing an external form of a circuit breaker. In FIG. 5, plural main parts 100 of the circuit breaker are contained in an insulation frame 20. An operation mechanism 21 is mounted the front face of the insulation frame 20. A handle 25 for operating the operation mechanism 21 is disposed on and penetrates a front face of the operation mechanism 21. Terminals 22 and 23 of the main parts 100 are disposed for penetrating the top face 20*a* of the insulation frame 20. The terminals 22 and 23 are fixed on the top face 20*a* of the insulation frame 20 by nuts 24.

Figure 6:
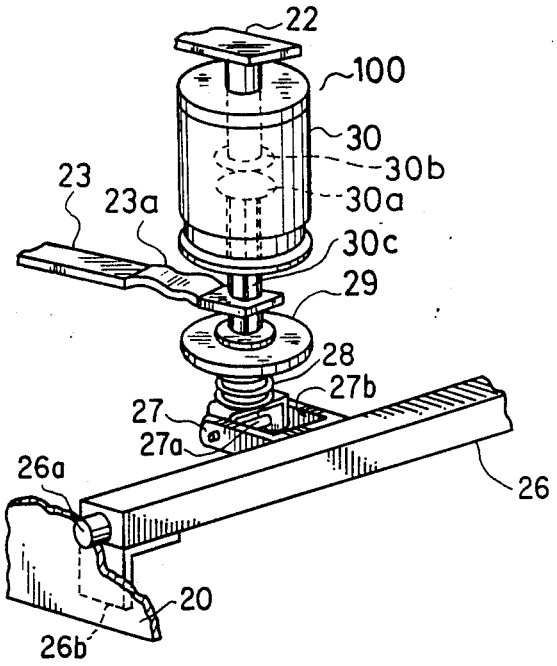
FIG. 6 is a perspective view of the main part of the circuit breaker.

FIG. 6 is a perspective view showing the constitution of the main part 100 of the circuit breaker 100 contained in the insulation frame 20. In FIG. 6, a crossing bar 26 is rotatably borne at both ends 26*a* thereof by the insulation frame 20. A lever 26*b* which is coupled to a driving mechanism 21 (which is not shown in FIG. 6) is disposed on the crossing bar 26 to be driven thereby. A U-letter shaped member 27 is also disposed on the crossing bar 26. Another U-letter shaped member 27*b* is rotatably held by the U-letter shaped member 27, and the levers 27 and 27b are joined by a pin 27a. An insulation plate 29 is fixed on a rod 30c which is fixed on the lever 27b and a flexible connection spring 28 is coaxially provided between the lever 27b and the insulation plate 29. The rod 30c is connected to a moving contact 30a of a vacuum switch tube 30. A fixed contact 30b of the vacuum switch tube 30 is connected to the terminal 22 and the rod 30c is connected to the terminal 23. A flexible part 23a is formed between the rod 30c and the terminal 23.

Figure 1:
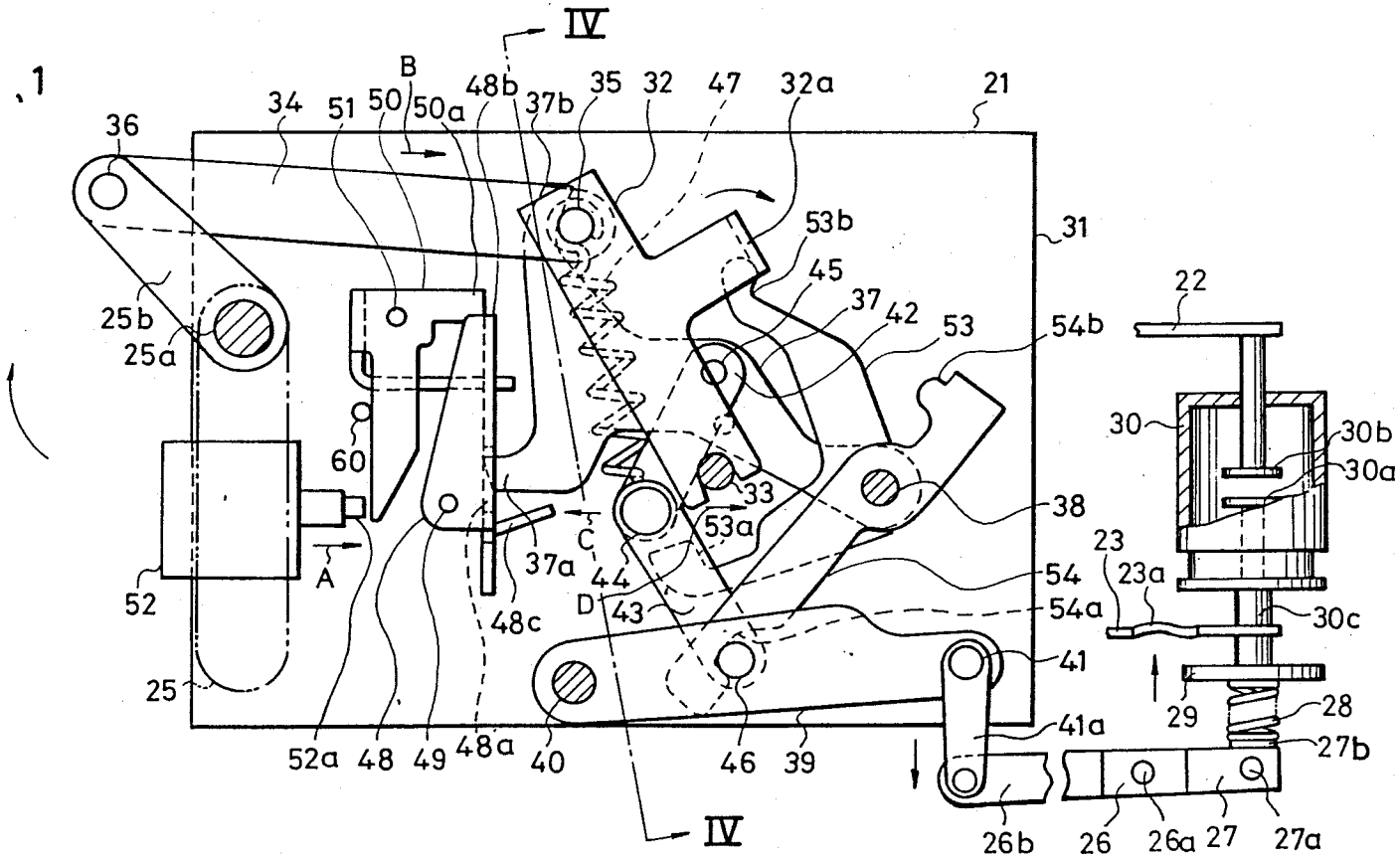
FIG. 1 is a cross-sectional front view showing a preferred embodiment of an operation mechanism of a circuit breaker in accordance with the present invention in the reset state.
Figure 2:
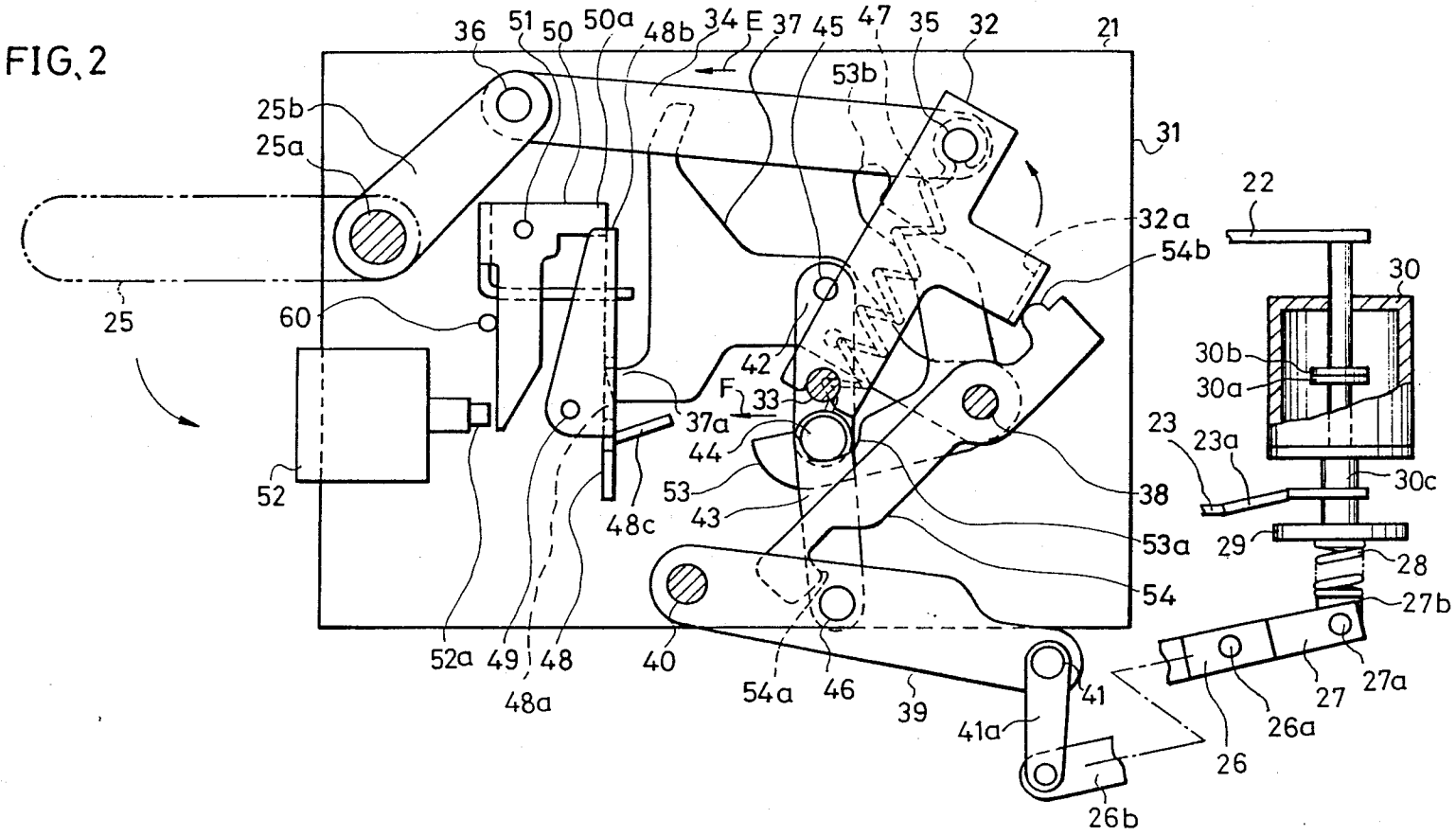
FIG. 2 is a cross-sectional front view showing the operation mechanism of the circuit breaker shown in FIG. 1 in the closing state of the contacts.
Figure 3:
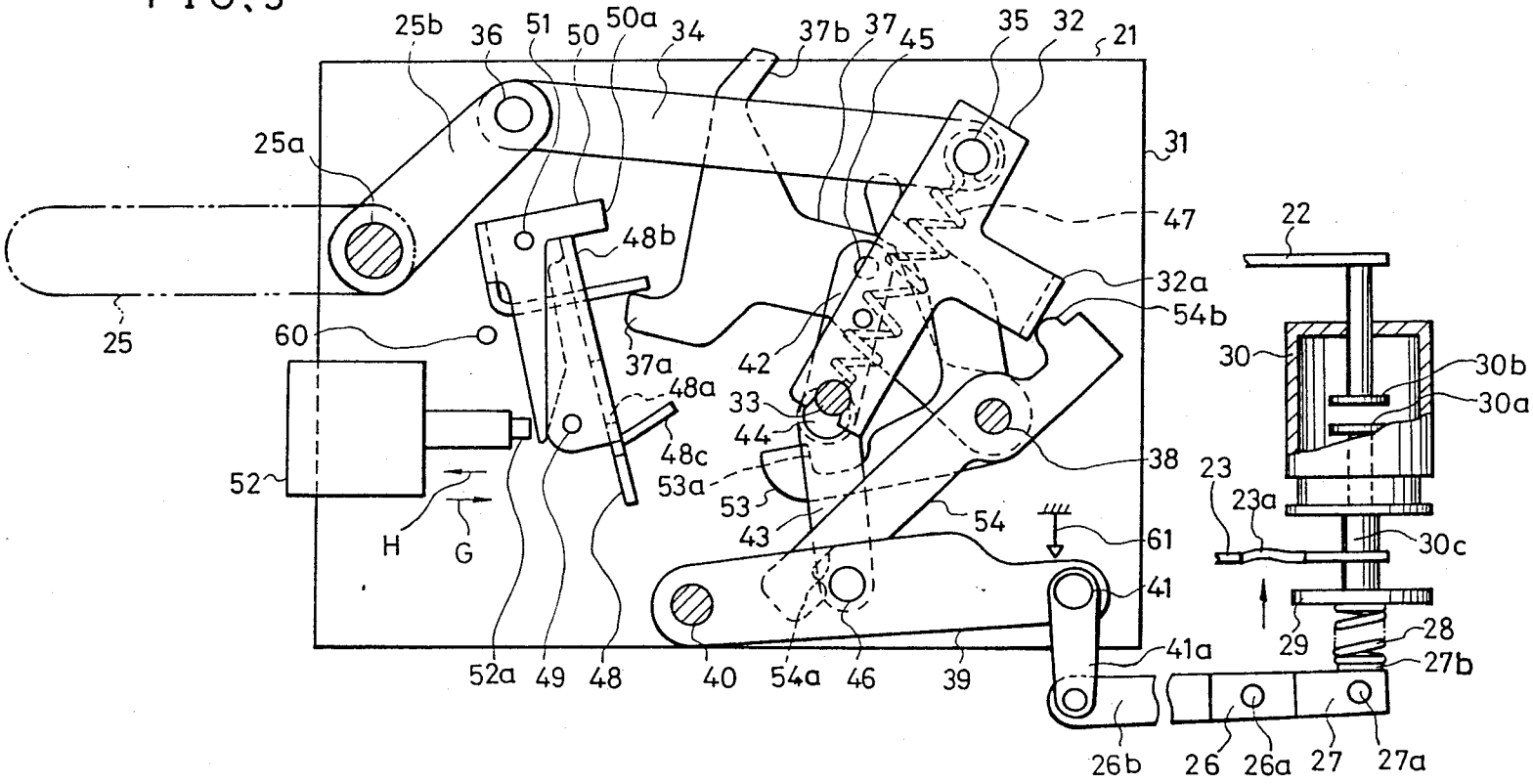
FIG. 3 is a cross-sectional front view showing the operation mechanism of the circuit breaker shown in FIG. 1 in the opening state of the contacts.
Figure 4:
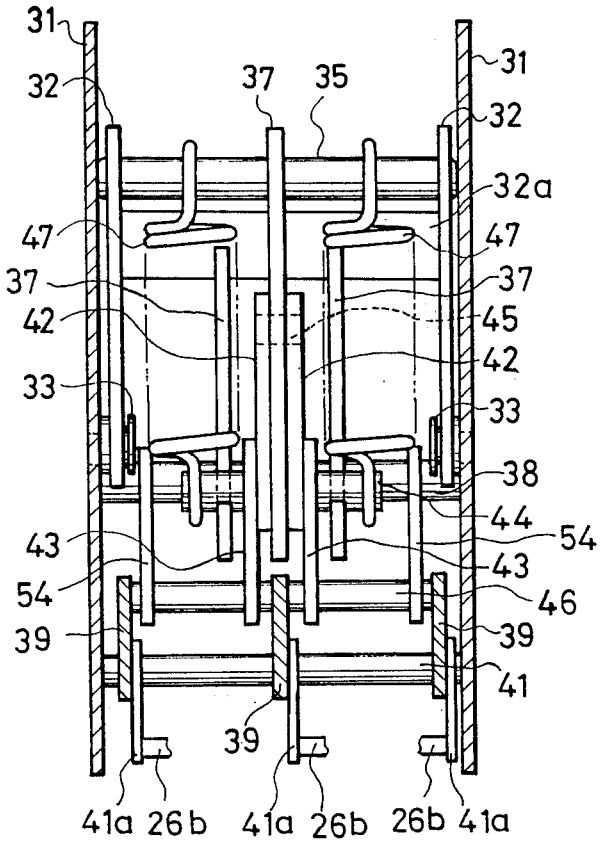
FIG. 4 is a side view through section line IV—IV of the operation mechanism of the circuit breaker shown in FIG. 1.

FIGS. 1, 2, 3 and 4 show details of the first embodiment of the operation mechanism 21 of the circuit breaker. FIG. 1 is a cross-sectional front view showing a reset state of the operation mechanism 21 when the contacts 30a and 30b of the circuit breaker are opened. FIG. 2 is a cross-sectional front view showing the operation mechanism 21 when the closing operation of the contacts 30a and 30b is completed. And FIG. 3 is a cross-sectional front view showing the operation mechanism 21 when the opening operation of the contacts 30a and 30b in tripping state is completed. FIG. 4 is a side view through sections line IV—IV of the operation mechanism in FIG. 1.

In the figures, the handle 25 with a shaft 25a is rotatably held on a frame 31. A lever 25b is fixed on the shaft 25a. A lever 32 is rotatably borne by a pivot 33 which is fixed on the frame 31. An end of a handle link lever 34 is rotatably borne by a pin 36 fixed on the lever 25b and the other end of the handle link lever 34 is rotatably borne by a pin 35 fixed on the lever 32. Namely, the handle link lever 34 links the handle 25 and the lever 32.

A hook lever 37 is rotatably borne by a pivot 38 on the frame 31 and has a hook part 37a to be hooked by a tripping latch lever 48 and a protrusion 37b for contacting with and driven by the pin 35 in the reset state. A moving contact lever 39 is rotatably borne at an end thereof by a pivot 40 which is fixed on the frame 31 and rotatably connected to a rod 41a at the other end. The rod 41a is connected to the lever 26b of the crossing bar 26 which is shown in FIG. 6 for rotating thereof by the rotation of the moving contact lever 39. Therefore, the moving contact 30a of the vacuum switch tube 30 is driven by the rotation of the moving contact lever 39.

An end of a first toggle link 43 is rotatably borne by a pin 46 on the moving contact lever 39 and the other end of the first toggle link 43 is rotatably connected to an end of a second toggle link 42 by a pin joint 44. The other end of the second toggle link 42 is rotatably borne by a pin 45 on the hook lever 37. Such a constitution of toggle links 42 and 43 serves as a toggle joint mechanism. A tension spring 47 is provided between the pin 35 and the pin joint 44 for supplying a force which tends to pull the pin 35 and the pin joint 44 towards each other. The tripping latch lever 48 is rotatably borne by a pivot 49 on the frame 31, and a spring which is not shown in the figure urges the tripping latch lever 48 in the counterclockwise direction around the pivot 49.

In a reset state shown in FIG. 1, the hook part 37a of the hook lever 37 engages with a hole 48a which is formed on a side wall of the tripping latch lever 48. An intermediate lever 50 is rotatably borne by a pivot 51 on the frame 31 and supplied with a force for rotation in the clockwise direction by a spring which is not shown in the figure. A latch apparatus consists of the tripping latch lever 48 and the intermediate lever 50. In FIG. 1, an end part 50a of the intermediate lever 50 engages with an end part 48b of the tripping latch lever 48 and holds the reset state of the circuit breaker. A stopper pin 60 holds the intermediate lever 50 so that it will not rotate past a predetermined angle in the clockwise direction. An electromagnet 52 serves a tripping function, and a plunger 52a protrudes in a direction shown by arrow A in FIG. 1 when the electromagnet 52 is excited. The protruded plunger 52a touches and drives the intermediate lever 50 for rotation in the counterclockwise direction.

A tripping delay latch 53 having substantially an L-letter shape is rotatably borne by the pivot 38 on the frame 31. A notch 53a for coupling the pin joint 44 is formed on an end of the tripping latch lever 53 and a protrusion part 53b for contacting a contacting part 32a of the lever 32 is formed on the other end thereof. The tripping delay latch 53 is urged by a spring not shown in the figure to be rotated in the clockwise direction around the pivot 38.

A closing delay latch 54 is rotatably borne by the pivot 38 and has a notch 54a on an end thereof for coupling the pin 46 and a protrusion part 54b on the other end for contacting the contacting part 32a of the lever 32. The closing delay latch 54 is urged by a spring not shown in the figure to be rotated in the counterclockwise direction around the pivot 38.

The notches 53a and 54a of the tripping delay latch 53 and the closing delay latch 54 are formed for satisfying the following conditions:

(i) when the notch 53a of the tripping delay latch 53 and the pin joint 44, and the notch 54a of the closing delay latch 54 and the pin 46 are respectively coupled, the line of action defined by connecting the pin joint 44 and the pin 46 passes the center of the pivot 38; and (ii) when the line of action defined by connecting the pin joint 44 and the pin 46 does not pass the center of the pivot 38, a moment is generated about the pivot 38 for making coupling of the notch 53a and the pin joint 44 with the notch 54a and the pin 44 firm.

Action of the operation mechanism is described in the following. FIG. 1 shows the reset state of the operation mechanism or the opening state of the contact of the circuit breaker. Under such a state, when the handle 25 is rotated in the clockwise direction around the handle shaft 25a, the lever 25b rotates in the clockwise direction and the handle link lever 34 moves in a direction shown by arrow B. As a result, the lever 32 rotates in the clockwise direction around the pivot 33. Since the tension spring 47 is installed between the pin 35 and the pin joint 44, the rotation of the lever 32 in the clockwise direction around the pivot 33 stretches the tension spring 47.

In such an initial state of the rotation, the toggle link mechanism which includes the first and second toggle links 42 and 43, the pin joint 44 and the pins 45 and 46 holds the initial state shown in FIG. 1 and the pin joint 44 is always given a force in a direction shown by arrow C by the stored force of the tension spring 47. As the lever 32 continues to rotate in the clockwise direction around the pivot 33, a line defined by connecting the pin 35 and the pin joint 44 crosses over a critical line on which the pin 35, the pin joint 44 and the pin 45 stand in a straight line. When the lever 32 further rotates in the clockwise direction around the pivot 33 and the pin 35 crosses over the critical line, the tension spring 47 supplies a force to the pin joint 44 to move it in a direction shown by arrow D. As a result, the pin joint 44 is driven in the direction shown by arrow D and the toggle link mechanism is extended. At this time, the hook part 37*a* of the hook lever 37 is hooked by the hole 48*a* of the tripping latch lever 48, so that the hook lever can not rotate and the pin 45 is held in the position shown in FIG. 1. Therefore, regardless of the tension on the toggle link mechanism towards the moving contact lever 39, the pin 46 on the moving contact lever 39 is coupled by the knotch 54*a* of the closing delay latch 54, and the pin 46 can not move from the position shown in FIG. 1.

When the lever 32 further rotates in the clockwise direction, the contact part 32*a* of the lever 32 touches the protrusion part 54*b* of the closing delay latch 54 and the closing delay latch 54 is rotated in the clockwise direction around the pivot 38. As a result, the pin 46 on the moving contact lever 39 is disconnected from the notch 54*a* of the closing delay latch 54, and the toggle link mechanism which consists of the first and the second toggle link 42 and 43, the pin 35, the pin joint 44 and the pin 46 is extended by a force stored in the tension spring 47. Thereby, the moving contact lever 39 is rotated in the clockwise direction around the pivot 40 and the moving contact 30*a* of the vacuum switch tube 30 which is connected to the moving contact lever 39 is closed.

The operation mechanism when the above-mentioned actions are completed is shown in FIG. 2. In FIG. 2, the notch 53*a* of the tripping delay latch 53 couples with the pin joint 44. This is the closing state of the contacts 30*a* and 30*b* of the circuit breaker. There are two ways for opening the contacts 30*a* and 30*b* of the circuit breaker from this state. One is a normal opening operation for resetting the lever 32 by hand operation. Another is tripping opereation which is an operation to be made by command from another control apparatus, such as in an accident.

First, the normal opening operation of the circuit breaker is described. In a state shown in FIG. 2, when the handle 25 is rotated in the counterclockwise direction around the handle shaft 25*a*, the handle link lever 34 is moved in a direction shown by arrow E and the lever 32 is rotated in the counterclockwise direction around the pivot 33. The rotation of the lever 32 in the counterclockwise direction extends the tension spring 47 for storing force.

As the lever 32 further rotates in the counterclockwise direction and crosses over the dead point where the pin 35, the pin joint 44 and the pin 45 stand in a straight line, the tension spring 47 supplies force to the pin joint 44 in a direction shown by arrow F. The pin joint 44 and the notch 53*a* of the tripping delay latch 53, however, couple with each other. Therefore, the pin joint 44 can not move in the direction shown by arrow F and holds the position shown in FIG. 2.

When the lever 32 further continues to rotate in the counterclockwise direction by continuous operation of the handle and aproaches the final position thereof, the contact part 32*a* of the lever 32 touches to the protrusion part 53*b* of the tripping delay latch 53, and the tripping delay latch 53 is rotated in counterclockwise direction around the pivot 38. As a result, the notch 53*a* of the tripping delay latch 53 and the pin joint 44 in the toggle link mechanism depart from each other and the pin joint 44 is moved in the direction shown by arrow F by a stored tension force of the tension spring 47. The moving contact lever 39 which is linked to the pin joint 44 by linking the second toggle link 43 is rotated in the counterclockwise direction around the pivot 40, so that the moving contact 30*a* is opened from the fixed contact 30*b* in the vacuum switch tube 30. FIG. 1 shows a state of the operation mechanism when the above-mentioned actions are completed.

Next, the tripping operation from the closing state of the contacts 30*a* and 30*b* of the circuit breaker shown in FIG. 2 is described. It is necessary to trip the circuit breaker when an accident such as shortcircuit or the like occurs in a closing state shown in FIG. 2. In this case, the electromagnet 52 is excited by an output of a protection relay (which is not shown in the figures). When the electromagnet 52 is excited, the plunger 52*a* is projected in a direction shown by arrow G in FIG. 3 and rotates the intermediate lever 50 in counterclockwise direction around the pivot 51. When the intermediate lever 50 is rotated in counterclockwise direction, the end part 48*b* of the tripping latch lever 48 released by the end part 50*a* of the intermediate lever 50.

Since the tripping latch lever 48 is forced by a spring not shown in the figure, the tripping latch lever 48 rotates in the counterclockwise direction when released by the intermediate lever 50, and the hook part 37*a* of the hook lever 37 is released from the hole 48*a* of the tripping latch lever 48. When the hook lever 37 is free from the hole 48*a*, the hook lever 37 is rotated in the clockwise direction by force stored in the tension spring 47. The moving contact lever 39 is linked to the hook lever 37 by the first and second link levers 42 and 43, and therefore the moving contact lever 39 rotates in the counterclockwise direction following the rotation of the hook lever 39, and opens the moving contact 30*a* from the fixed contact 30*b* in the vacuum switch tube 30. At this time, the moving contact lever 39 is stopped at a predetermined position by a stopper 61.

FIG. 3 shows a state of the operation mechanism when the above-mentioned tripping operation is completed. In this state, when the excitation of the electromagnet 52 is stopped, the plunger 52*a* is moved in a direction shown by arrow H in FIG. 3 and returns to the position shown in FIG. 1. Furthermore, for resetting the operation mechanism 21 as shown in FIG. 1, the handle 25 should be rotated in the counterclockwise direction around the handle shaft 25*a*. Thereby, the lever 32 which is linked to the handle 25 by the link lever 34 is rotated in the counterclockwise direction around the pivot 33. As a result, the pin 35 contacts the protrusion part 37*b* of the hook lever 37 for rotation of the hook lever 37 is counterclockwise direction around the pivot 38.

When the handle 25 is rotated in the counterclockwise direction a little more from the position shown in FIG. 1, the hook lever 37 also rotates a little more in the counterclockwise direction, and the hook part 37*a* of the hook lever 37 contacts a protrusion part 48*c* of the tripping latch lever 48. When the hook lever 37 continues the rotation in the counterclockwise direction, the tripping latch lever 48 is rotated in the clockwise direction around the pivot 49 and the hook part 37*a* of the hook lever 37 engages with the hole 48*a* of the tripping latch lever 48. At this time, the intermediate lever 50 is rotated in the clockwise direction around the pivot 51 by the force of a spring not shown in the figure and its rotation is stopped by abutment with the stopper pin 60.

After that, when the force supplied to the handle 25 is released, the handle 25 returns to the position shown in FIG. 1 by the force stored in the tension spring 47, and also the hook lever 37 returns to the initial position shown in FIG. 1. Therefore, the end part 48*b* of the tripping latch lever 48 and the end part 50*a* of the intermediate lever 50 are hooked and the hook part 37*a* of the hook lever 37 and the hole 48*a* of the tripping latch lever 48 are coupled as shown in FIG. 1. In the above-mentioned operations, when the lever 32 crosses over the dead point at which the pin 35, the pin joint 44 and the pin 45 lies on a straight line, the force stored in the tension spring 47 acts in a direction to open the moving contact 30*a* from the fixed contact 30*b* in the vacuum switch tube 30. Following the above-mentioned operations, the operation mechanism 21 returns to a reset state shown in FIG. 1.

Figure 7:
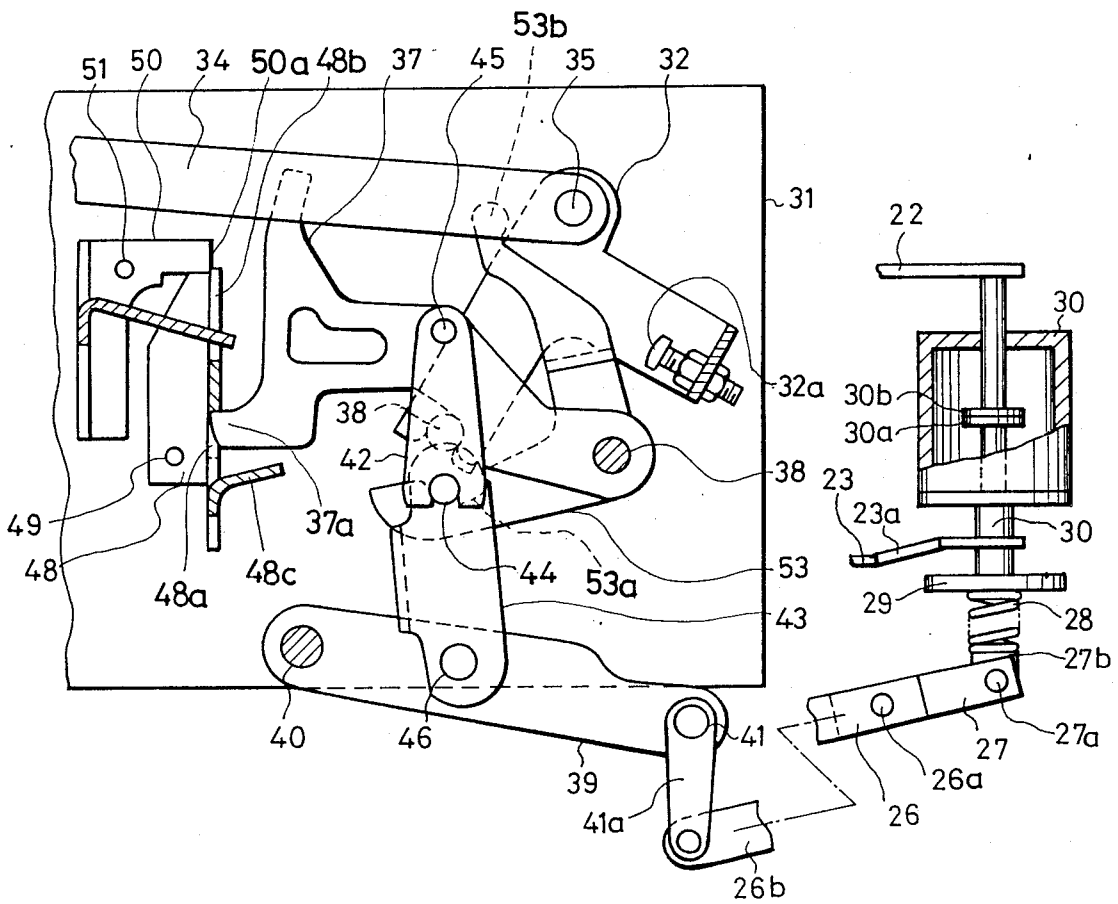
FIG. 7 is a cross-sectional front view showing another preferred embodiment of an operation mechanism of a circuit breaker in accordance with the present invention.
Figure 8:
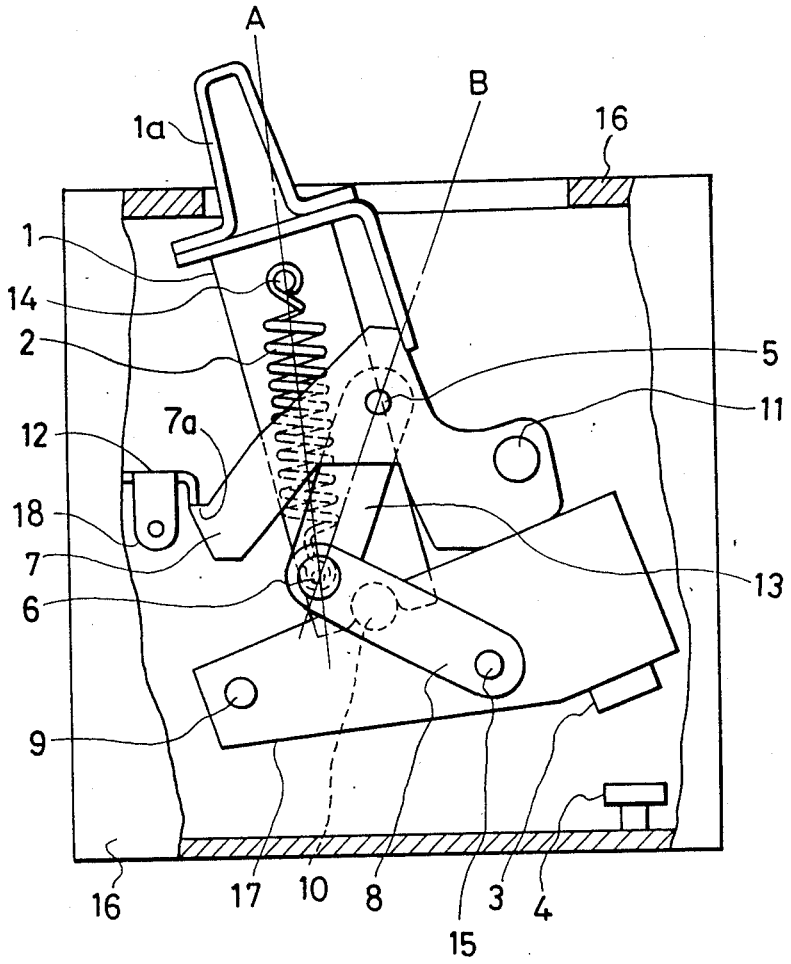
FIG. 8 (Prior Art)
FIG. 8 is a cross-sectional view showing a conventional operation mechanism of a circuit breaker.

Another preferred embodiment of an operation mechanism of a circuit breaker in accordance with the present invention is shown in FIG. 7.

Elements designated by the same numerals in the above-mentioned embodiment shown in FIGS. 1 to 3 are substantially the same or similar. Therefore, detailed descriptions are omitted. In the above-mentioned embodiment shown in FIGS. 1 to 3, the contacting part 32*a* of the lever 32 is formed by bending of a metal plate. On the other hand, the contacting part 32*a* of the lever 32 in FIG. 7 consists of a screw and plural nuts. Thereby, the timing of the action of the tripping delay latch 53 or the closing delay latch 54 can easily be adjusted.

Furthermore, FIGS. 1 to 3 and FIG. 7 show embodiments equipped with the handle 25 on the handle shaft 25*a*. However, still other embodiments are possible in which the handle 25 is not included and the handle shaft 25*a* is driven by a tool or the like.

Although the invention has been described in its preferred form with a certain degree of particularity, it is understood that the present disclosure of the preferred form may be changed in the details of construction and the combination and arrangement of parts without departing from the spirit and the scope of the invention as hereinafter claimed.

What is claimed is:

1. An operation mechanism of a circuit breaker comprising:

a moving contact lever, rotatably borne at one end thereof by a first pivot and having a moving contact on the other end thereof;

a hook lever rotatably borne at one end thereof by a second pivot and hooked at the other end by a latch apparatus;

first and second toggle links coupled by a pin joint, serving as a toggle joint for joining a first pin on said moving contact lever and a second pin on said hook lever;

an operation lever rotatably borne at one end thereof by a third pivot;

a spring for supplying a force stored therein to said moving contact lever, said spring being disposed between a third pin and said pin joint of said first and second toggle links, said third pin being provided on said operation lever a predetermined distance from said third pivot;

a closing operation delay latch rotatably borne at an intermediate position thereof by a fourth pivot, having a first notch at a predetermined position and a first contacting part on the other end for contacting said operation lever when said operation lever comes close to a final position in a closing operation, said closing operation delay latch holding said moving contact lever at an opening position of said circuit breaker through coupling of said first notch to a protrusion of said moving contact lever when said operation lever is at a reset position; and an opening operation delay latch rotatably borne at an intermediate position thereof by said fourth pivot, having a second notch on an end part thereof and a second contacting part on the other end thereof, said second contacting part contacting said operation lever and being driven thereby when said operation lever comes close to a final position in an opening operation, and said second notch holding said moving contact lever at a closing position of said circuit breaker through coupling of said second notch to said pin joint when said operation lever is at a closed position.

2. An operation mechanism of a circuit breaker, comprising:

moving means for moving a circuit breaker contact, said moving means including a moving contact lever;

first actuating means for automatically actuating said moving contact lever, said first actuating means including a hook lever and release means for automatically releasing said hook lever;

connecting means for movably connecting said hook lever and said moving contact lever, said connecting means including a pair of toggle links;

second actuating means for manually actuating said moving contact lever, said second actuating means including a handle, an operation lever connected to said handle, and a spring connected between said operation lever and said pair of toggle links;

first delaying means for delaying manual actuation of said moving contact lever in one direction, said first delaying means including a closing operation delay latch; and second delaying means for delaying manual actuation of said moving contact lever in an opposite direction, said second delaying means including an opening operation delay latch.

3. An operation mechanism of a circuit breaker as claimed in claim 1, wherein said moving contact lever is rotatably borne at one end thereof by a first pivot and having a moving contact on the other end thereof, said hook lever is rotatably borne at one end thereof by a second pivot and hooked at the other end thereof by a latch apparatus of the release means, and said operation lever is rotatably borne at one end thereof by a third pivot.

4. An operation mechanism of a circuit breaker as claimed in claim 2, wherein:

said closing operation delay latch has a first notch at a predetermined position thereof and a first contacting part spaced from said notch thereon, and said opening operation delay latch has a second notch thereon and a second contacting part spaced from said second notch thereon.

5. An operation mechanism of a circuit breaker as claimed in claim 4, wherein:

said first notch couples with a protrusion of said moving contact lever when said circuit breaker is in an open position, said operation lever contacts said first contacting part during a closing operation of said operation mechanism to uncouple said first notch and said protrusion, and said second notch couples with a pin joint of said pair of toggle links when said circuit breaker is in a closed position, said operation lever contacts said second contacting part during an opening operation of said operation mechanism to uncouple said second notch and said pin joint.

* * * * *